US008967232B2

(12) United States Patent
Werner et al.

(10) Patent No.: US 8,967,232 B2
(45) Date of Patent: Mar. 3, 2015

(54) VACUUM DIE-CASTING SYSTEM AND METHOD FOR OPERATION OF SUCH A VACUUM DIE-CASTING SYSTEM

(71) Applicant: KSM Castings Group GmbH, Hildesheim (DE)

(72) Inventors: Michael Werner, Hildesheim (DE); Thomas Zwirner, Sarstedt (DE); Juergen Hofmeister, Hildesheim (DE); Roman Kaczmarczyk, Sarstedt (DE)

(73) Assignee: KSM Castings Group GmbH, Hildesheim (DE)

( * ) Notice: Subject to any disclaimer, the term of this patent is extended or adjusted under 35 U.S.C. 154(b) by 0 days.

(21) Appl. No.: 14/302,916

(22) Filed: Jun. 12, 2014

(65) Prior Publication Data

US 2014/0290893 A1 Oct. 2, 2014

Related U.S. Application Data

(62) Division of application No. 13/497,106, filed as application No. PCT/DE2010/001104 on Sep. 22, 2010, now Pat. No. 8,813,815.

(30) Foreign Application Priority Data

Sep. 22, 2009 (DE) ..... 10 2009 042 253
Nov. 23, 2009 (DE) ..... 10 2009 054 174

(51) Int. Cl.
*B22D 17/14* (2006.01)
*B22D 17/20* (2006.01)

(52) U.S. Cl.
CPC ..... *B22D 17/14* (2013.01); *B22D 17/203* (2013.01)
USPC ..... 164/312; 164/256; 164/253; 164/113; 164/61

(58) Field of Classification Search
CPC ..... B22D 17/14; B22D 17/203
USPC ..... 164/61–65, 113, 253, 256, 258, 312
See application file for complete search history.

(56) References Cited

U.S. PATENT DOCUMENTS

| | | | | |
|---|---|---|---|---|
| 4,726,415 | A * | 2/1988 | Ueno et al. | 164/253 |
| 4,779,664 | A * | 10/1988 | Dannoura | 164/65 |
| 5,199,480 | A | 4/1993 | Schultz et al. | |
| 5,379,826 | A | 1/1995 | Miwa et al. | |
| 2009/0050289 | A1 | 2/2009 | Lismont | |
| 2009/0139683 | A1 | 6/2009 | Muller et al. | |

FOREIGN PATENT DOCUMENTS

| | | | |
|---|---|---|---|
| DE | 43 12 647 | A1 | 10/1993 |
| DE | 10 2004 057 324 | A1 | 6/2006 |
| DE | 10 2006 010 560 | A1 | 9/2007 |
| EP | 1 057 558 | A1 | 12/2000 |

(Continued)

OTHER PUBLICATIONS

International Search Report of PCT/DE2010/001104, mailed Jan. 20, 2011.

(Continued)

*Primary Examiner* — Kevin E Yoon
(74) *Attorney, Agent, or Firm* — Collard & Roe, P.C.

(57) ABSTRACT

The invention relates to a vacuum die-casting system and a method for operating a vacuum die-casting system.

3 Claims, 4 Drawing Sheets

(56) References Cited

FOREIGN PATENT DOCUMENTS

| | | | |
|---|---|---|---|
| EP | 1 832 362 | B1 | 9/2009 |
| JP | 61-232050 | A | 10/1986 |
| JP | 63-144852 | A | 6/1988 |
| JP | 1-313171 | A | 12/1989 |
| JP | 1-313174 | A | 12/1989 |
| JP | 2002-346717 | A | 12/2002 |
| JP | 2004-268051 | A | 9/2004 |
| WO | 2007/042282 | A2 | 4/2007 |

OTHER PUBLICATIONS

English translation of the International Preliminary Report on Patentability and Written Opinion of the International Searching Authority in PCT/DE2010/001104, mailed Apr. 12, 2012.

* cited by examiner

VACUUM DIE-CASTING SYSTEM AND METHOD FOR OPERATION OF SUCH A VACUUM DIE-CASTING SYSTEM

CROSS REFERENCE TO RELATED APPLICATIONS

This application is a divisional of and Applicant claims priority under 35 U.S.C. §§120 and 121 of parent U.S. patent application Ser. No. 13/497,106 filed Mar. 20, 2012, which application is a national stage application under 35 U.S.C. §371 of PCT/DE2010/001104 filed on Sep. 22, 2010, which claims priority under 35 U.S.C. §119 of German Application No. 10 2009 042 253.6 filed on Sep. 22, 2009 and German Application No. 10 2009 054 174.8 filed on Nov. 23, 2009, the disclosures of each of which are hereby incorporated by reference. The international application under PCT article 21(2) was not published in English. Certified copies of priority German Application Nos. 10 2009 042 253.6 and 10 2009 054 174.8 are contained in parent U.S. application Ser. No. 13/497,106.

BACKGROUND OF THE INVENTION

1. Field of the Invention

The invention relates to a vacuum die-casting system, as well as to a method for operation of a vacuum die-casting system.

2. Description of the Related Art

Vacuum die-casting is known for the production of cast pieces made of metals and metal alloys, particularly of alloys of the metals Al, Mg, Zn, and Cu. Corresponding systems for vacuum die-casting are described, for example, in DE 4312647 A1, DE 102004057324 A1, or DE 102006010560 A1.

Vacuum die-casting is particularly used where great demands are made on the sealing ability, elongation to fracture, strength and weldability of the cast parts. A high quality of the cast parts is achieved by means of vacuum die-casting, because less air and gases are enclosed in the material. This is particularly true for cast parts made of aluminum or an aluminum alloy, which are still heat-treated or welded in a subsequent method step.

Aside from the use of liquid metals or metal alloys, there are various special methods in vacuum die-casting, such as those described in "Rolf Roller (ed.): Fachkunde für Gießereitechnische Berufe [Technical knowledge for foundry technology professions], Haan-Gruiten, 2007; pages 186-187." The present invention also comprises such special methods, to the extent that the corresponding vacuum die-casting systems have a casting chamber having a filling opening, a casting piston that can move in the casting chamber, and a piston rod, whereby the latter connects the casting piston with a casting drive, and whereby a ring gap is formed between the outer mantle of the casting piston and the inner wall of the casting chamber, which gap usually forms a leak site—as described below.

In vacuum die-casting, it is known that a partial vacuum or vacuum is produced in the mold cavity of the vacuum die-casting system, after the casting chamber has been filled with casting melt and the casting piston has moved past the filling opening of the casting chamber.

Tn order to bring the partial vacuum produced in the mold cavity of the casting mold or in the casting chamber connected with the mold cavity to a minimum during vacuum die-casting, is necessary to seal off all possible leaks or defects within the complete vacuum system, to the greatest possible extent.

An extremely important leak site, in this connection, is the ring gap between the inner wall of the casting chamber and the outer mantle of the casting piston. At this leak site, gases that penetrate from the back side of the casting piston actually foam up the casting melt in the casting chamber, which is under vacuum, and produce a gas porosity in the cast part that minimizes or excludes heat treatment and weldability.

DE 43 12 647 A1 offers a solution for closing this leak site, according to which a very complicated slide sleeve that can be evacuated is pushed over the casting chamber system or casting piston system, in order to produce a vacuum behind the piston. In this connection, the very great maintenance effort of such vacuum die-casting systems is particularly disadvantageous.

SUMMARY OF THE INVENTION

The invention is based on the task of avoiding the disadvantages of the state of the art and of improving the process for the production of vacuum die-cast parts, so that the quality of the cast parts increases. The invention is furthermore based on the task of improving the sealing ability, elongation to fracture, strength, heat-treatability and/or weldability of the cast parts produced by means of vacuum die-casting. Another task of the invention consists in accelerating the cycle time during vacuum die-casting and thereby increasing the production output.

Furthermore, the invention is based on the task of improving the process for the production of vacuum die-cast parts or a vacuum die-casting system, in such a manner that a greater vacuum can be adjusted in the casting mold cavity.

According to the invention, this task is accomplished, in the case of a vacuum die-casting system that has a casting chamber with a filling opening, a casting piston that can be moved in the casting chamber, and a piston rod that connects the casting piston with a casting drive, whereby a ring gap is configured between the outer mantle of the casting piston and the inner wall of the casting chamber, in that the casting piston has at least one depression or hollow that stands in a flow connection with the ring gap and can be evacuated, and that means are provided by way of which the depression or hollow, preferably a groove, can be evacuated.

According to the invention, the term piston rod is defined broadly. It comprises not only a piston rod in the narrower sense, which is preferably advantageous for the majority of application cases, but also other activation means that move the casting piston within the casting chamber, in linear manner. For certain application cases, it can be advantageous if the piston rod is a connecting rod. For specific individual cases, yet again, it can be practical if the rod that drives the casting piston is part of an eccentric mechanism.

It has been shown that the decisive parameters for the flow velocity of the gases within the leak site between the inner wall of the casting chamber and the outer mantle of the casting piston are the gap width between casting piston and casting chamber and the pressure difference over the gap.

Because it is not possible to work without a gap, due to great heat differences in the casting chamber region, the result is achieved, by means of the depression or hollow provided according to the invention, that less to preferably no gases or air flow(s) through the gap into the casting chamber that contains the casting melt, when a partial vacuum is produced in the casting mold cavity or in the casting chamber connected with it in terms of flow technology.

Essentially, a region that is free of pressure differences, to a great extent, is created, so that as compared with the state of the art, less, preferably only a minimal amount of to no gases or air flow(s) through the gap into the casting chamber filled with casting melt.

According to the invention, the partial vacuum in the depression or hollow can, particularly preferably, actually be greater than in the casting chamber filled with casting melt, so that the flow direction essentially reverses as compared with the state of the art, and gases and air flow(s) out of the casting chamber filled with casting melt and into the depression or hollow. In the latter case, of course, a desired pressure difference is then present again over the ring gap.

As a result, effective sealing of the ring gap between the outer mantle of the casting piston and the inner wall of the casting chamber during vacuum die-casting is achieved, in such a manner that no gases or air flow(s) through the ring gap into the casting chamber filled with casting melt. Furthermore, an undesirable so-called drawing of the melt out of the casting chamber into the mold cavity is prevented.

The cast parts produced using the vacuum die-casting system according to the invention are characterized by better sealing ability, elongation to fracture, strength, heat-treatability and weldability.

As compared with the state of the art, the invention is particularly characterized in that the ability of the vacuum die-casting system to function can easily be checked, and the vacuum die-casting system does not require any additional movable components for sealing off the ring gap between casting piston and casting chamber, which components would be very susceptible to wear and maintenance-intensive, in disadvantageous manner.

It is advantageous that all the components of the vacuum die-casting system according to the invention are very easily accessible for maintenance work on the vacuum die-casting system and can easily be replaced.

In total, the further development according to the invention can also be produced, in cost-advantageous manner, for vacuum die-casting systems that are already in use.

The control effort for evacuating the depression or hollow is minimal, and preferably takes place by way of a path and/or time control.

The further development according to the invention, of known vacuum die-casting systems, advantageously leads to no lengthening of the cycle time. Instead, shortening or acceleration of the cycle time, in other words of the time period between completion of two cast parts, can be achieved. This is attributable not only to the minimization to elimination of the undesirable leak through the ring gap, but also to a less complicated process management of the vacuum die-casting system according to the invention, which tends to have few system failures and little maintenance work.

Furthermore, the further development according to the invention can be implemented without any reconstruction work on the casting mold itself, and can be used for vacuum die-casting systems having different dimensions.

Another advantage of the invention consists in that a higher vacuum can be achieved in the casting mold cavity, thereby further improving the quality of the cast piece.

For specific application cases, it can be advantageous if the depression or hollow is configured in the casting piston itself. This can advantageously be done by original shaping of such a casting piston, or preferably later, by means of cutting machining of the casting piston, particularly by means of milling or grinding.

For other application cases, it can be advantageous if the depression or hollow is configured directly or indirectly behind the casting piston, by means of placement of at least one work piece behind the casting piston, whereby the placement of the depression or hollow behind the casting piston is such that the depression or hollow can be brought into the region of the casting chamber that is not filled with casting melt, before it is evacuated, by means of moving the casting piston into the casting chamber.

For specific purposes of use, the depression or hollow can be configured in the work piece itself. For other purposes of use, it can be advantageous if the work piece is spaced apart from the casting piston in such a manner that the depression or hollow forms between casting piston or at least one other work piece disposed behind the casting piston and the work piece mentioned first. For yet other purposes of use, it can also be advantageous if the depression or hollow is configured in the work piece itself, in combination with the spaced-apart arrangement mentioned above.

Particularly for retro-fitting existing pressure-casting systems, it can be advantageous if the work piece is configured in the manner of a ring, and preferably can be pushed onto and fixed in place on the piston rod. Particularly by means of a conical configuration of the ring opening and/or the piston rod, such a work piece can be fixed in place on the piston rod in simple manner, by means of wedging. Of course, the work piece can also be disposed behind the casting piston, by means of other methods of attachment that, although less preferred, are nevertheless advantageous for specific cases of use, particularly by means of a screw connection, press fit, or welding.

For specific cases of use, it can be practical if the casting piston is configured in multiple parts. Preferably, however, the casting piston is configured in one part, i.e. in one piece.

Furthermore, it can be advantageous if the casting piston is configured to be solid.

In order to prevent undesirable substances, for example metal flakes or lubricants, from getting through the ring gap into the at least one depression or hollow that can be evacuated, during vacuum die casting, it can be practical if at least one collection depression is provided, which stands in a flow connection with the ring gap and is disposed in front of the at least one depression or hollow that can be evacuated. The at least one collection depression then essentially serves as a dirt trap and particularly also prevents the undesirable substances from getting into the vacuum system and/or from clogging up the vacuum suction lines that proceed from the at least one depression or hollow that can be evacuated.

It can be advantageous if the collection depression and/or the depression that can be evacuated is/are configured as a depression that surrounds the outer mantle of the casting piston, of the piston rod and/or of the work piece, preferably in the form of a ring groove.

It is advantageous if a circumferential depression that can be evacuated is disposed completely within the flow path of the gases or of the air, so that little to preferably no gases or air get(s) through the gap between casting chamber and casting piston into the casting chamber. An undesirable pressure difference known according to the state of the art, which occurs during evacuation of the casting mold cavity or of the casting chamber, and leads to inflow of gases or air through the ring gap into the casting chamber, is clearly reduced to preferably eliminated. Particularly preferably, the undesirable pressure difference is actually reversed, in that the partial vacuum within the depression or hollow is selected to be greater than in the casting chamber filled with casting melt or in the mold cavity of the casting mold connected with the casting chamber in terms of flow technology. Therefore a desired pressure difference occurs, which brings about a reversal of the flow direction.

A circumferential collection depression can be particularly practical for creating the most comprehensive possible limit for undesirable substances, and for preventing the penetration of such substances into the depression or hollow, to the greatest possible extent.

For specific cases of use, however, it can also be advantageous if the collection depression and/or the depression or hollow that can be evacuated is provided only in the upper outer mantle region of the casting piston, of the piston rod and/or of the work piece. This is because it has been shown that the ring gap between the outer mantle of the casting piston and the inner wall of the casting chamber is not uniform, but rather larger at the top than at the bottom, as a function of the vacuum die-casting system used and/or of the dimensions and of the weight of the casting piston that can move in the casting chamber.

Furthermore, it can be practical if multiple depressions or hollows are provided, spaced apart form one another in the circumference direction of the casting piston, of the piston rod and/or of the work piece.

For example, it can be advantageous if these depressions are disposed distributed over the circumference of a work piece configured as a ring. These depressions can be bores that pass through to the inside of the ring. The work piece can be disposed directly behind the casting piston, whereby a vacuum merely needs to be applied to the inside of the ring to evacuate these depressions. A circumferential depression can be advantageously created, in this connection, if the stated ring has a lesser outside diameter than the casting piston, whereby then, a further work piece, preferably also a ring, is disposed behind the ring for production of the circumferential depression, which ring has the same outside diameter as the casting piston. In this case, the individual depressions or bores then form a kind of nozzle field, by means of which the single circumferential depression can be uniformly evacuated.

Furthermore, it can be practical if multiple collection depressions are provided, spaced apart from one another in the circumference direction of the casting piston, of the piston rod and/or of the work piece.

It can be practical if the depression or hollow that can be evacuated is dimensioned and can be evacuated in such a manner that during evacuation of the casting mold cavity or of the casting chamber, less to preferably no gases or air flow(s) into the casting chamber through the ring gap, and, particularly preferably, the flow direction in the ring gap reverses and the gases or air flow(s) in the direction of the depression or hollow that can be evacuated. A pressure difference that prevails, according to the state of the art, during evacuation of the casting mold cavity or of the casting chamber, which difference leads to flow of gases or air into the casting chamber through the gap, i.e. essentially a pressure difference between the chamber filled with casting melt, in front of the casting piston, and the depression or hollow, is minimized, preferably eliminated, particularly preferably reversed by means of the evacuation of the depression or hollow according to the invention.

It can be advantageous if the depression or hollow that can be evacuated has a vacuum applied to it in such a manner that during evacuation of the casting mold cavity or casting chamber, less to preferably no gases or air flow(s) into the casting chamber through the stated gap, and, particularly preferably, the flow direction in the gap reverses and the gases or air flow(s) in the direction of the depression or hollow that can be evacuated.

It can be advantageous if the means for evacuation of the depression or hollow have at least one recess, particularly a longitudinal recess, within the piston rod, which recess is connected, in terms of flow technology, with the depression or hollow that can be evacuated, with its one end, and connected with a vacuum system, in terms of flow technology, with its other end.

It can be particularly advantageous if the at least one depression that can be evacuated can be used for introduction of a lubricant or another functional substance into the casting chamber any time when it is not being evacuated, whereby the lubricant or other functional substance can then be introduced into the depression or hollow and thus into the casting chamber by way of the at least one vacuum suction line connected with the depression, or another line provided for this purpose.

It can be particularly advantageous if the means for evacuation of the depression or hollow comprise at least one line or bore contained in the piston rod, particularly a coolant line or bore.

It is practical if the means comprise at least one, preferably two or more suction lines, particularly suction pipes, which are connected, in each instance, with the depression or hollow that can be evacuated, in terms of flow technology, with their one end, and with a vacuum system, in terms of flow technology, with their other end.

It can be advantageous if the suction line, particularly the suction pipe, runs along the piston rod, preferably in a groove introduced into the outside of the piston rod, and makes a transition into the depression or hollow with its one end, by means of the piston region or work piece region that faces the piston rod, and is connected with it in terms of flow technology.

It can be advantageous if the cross-section of the recess or of the suction line, particularly of the suction pipe, is selected to be so great that the vacuum that can be adjusted in the depression or hollow is maintained over a predetermined period of time, despite the existing leak between depression or hollow and the region that is disposed behind the depression or hollow and by way of which the ring gap that proceeds from the depression or hollow and leads to the piston rod is connected with the depression or hollow, in particular over the period of time during which the casting chamber and the casting mold cavity are being evacuated and a partial vacuum is being maintained in the casting mold cavity.

It can be practical if at least one suction pipe is provided within the piston rod, which pipe makes a transition, with its one end, into the depression or hollow, and is connected with it in terms of flow technology.

It can be advantageous if the vacuum die-casting system is a cold chamber vacuum die-casting system.

It can be advantageous if a control for the vacuum die-casting system is provided, which control is connected with a control for the vacuum system, and if a start signal is transmitted to the vacuum system for evacuation of the depression or hollow by way of this connection.

A further development of the invention provides that the depression or hollow is disposed as close as possible to the region of the casting piston that faces the casting chamber filled with melt. In this way, the result is achieved that the depression or hollow can be evacuated at an early point in time, so that the switching time or use time of the vacuum is increased and the quality of the cast product is improved even further by means of a correspondingly improved vacuum.

The invention finally also relates to a method for operation of a vacuum die-casting system, particularly one according to one of claims 1 to 21, comprising the following method steps:

a) introducing a casting melt into the casting chamber, through the filling opening, b) moving the casting piston until the depression or hollow has gone past the filling opening, or tightly closing the filling opening and, if necessary, moving the casting piston until the depression or hollow is positioned in the casting chamber, and c) evacuating the depression or hollow, in such a manner that less to preferably no gases or air flow(s) into the casting chamber through the gap between casting piston and casting chamber, particularly preferably in such a manner that the flow direction in the gap reverses and the gases or air flow(s) in the direction of the depression or hollow that can be evacuated.

The method according to the invention leads to a clear qualitative improvement in the cast parts.

It can be advantageous if the evacuation of the depression or hollow is started by way of a path control for some application cases, and by way of a time control for other application cases. For specific application cases, a combination of path and time control can also be advantageous.

BRIEF DESCRIPTION OF THE DRAWINGS

Further details and advantageous embodiments of the invention are evident from the following description, in combination with the drawing. In this drawing, the figures show.

When the same reference symbols are used in FIGS. 1 to 4, these also refer to the same parts or regions.

DETAILED DESCRIPTION OF THE PREFERRED EMBODIMENTS

Figure 1:
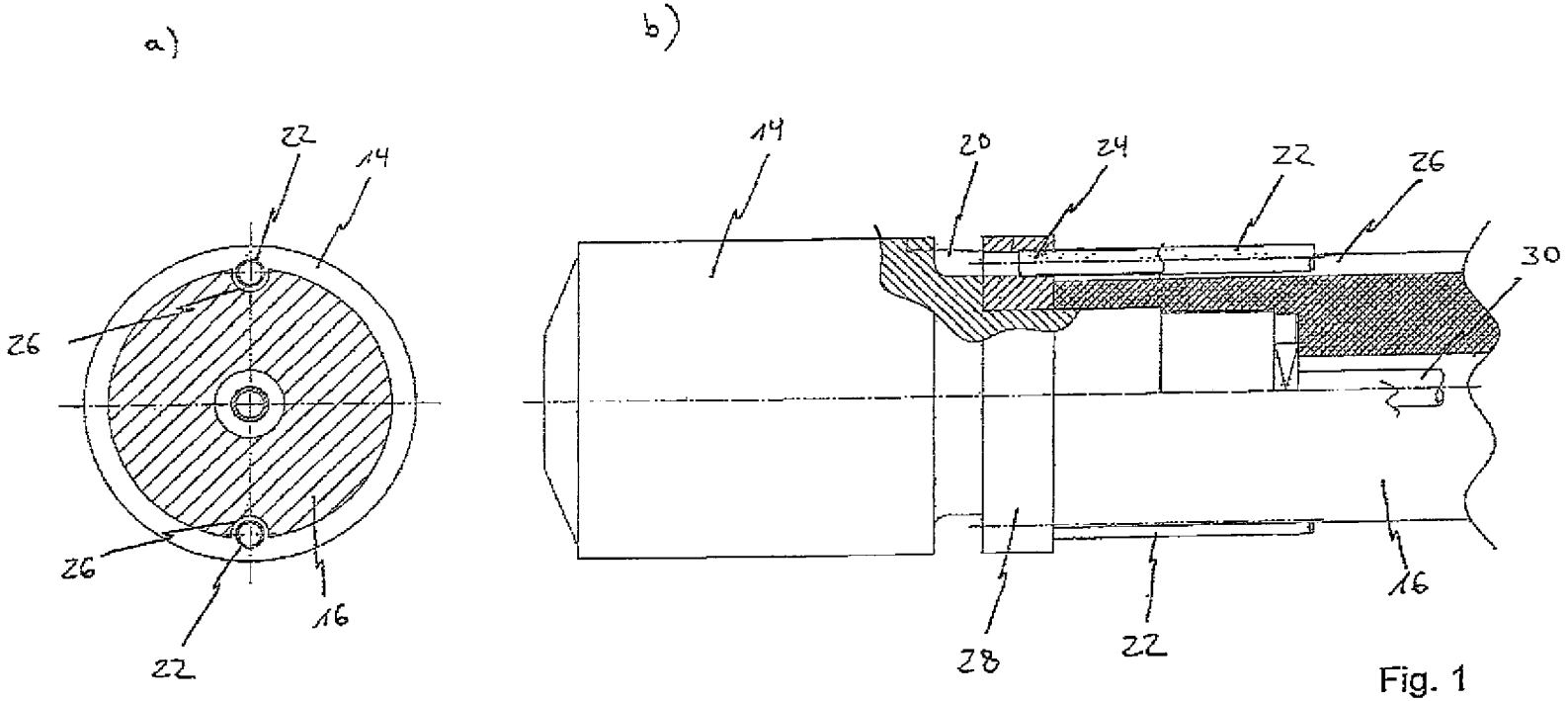
FIG. 1 in a), a section through a piston rod configured according to the invention, and in b), a view (with partial sections) from above of the casting piston including piston rod and circumferential depression, FIG. 2 a detail of the casting chamber, with the casting piston configured according to the invention, with a partial view of the piston rod, FIG. 3 in a), a section through a piston rod configured according to the invention, as in FIG. 1*a*), and in b), a view (with partial sections) from above of the casting piston including piston rod and circumferential depression, with nozzle field, and FIG. 4 in a), a section through a piston rod configured according to the invention, as in FIG. 1*a*), and in b), a view (with partial sections) from above of the casting piston including piston rod and circumferential depression, as well as the preceding collection depression.
Figure 2:
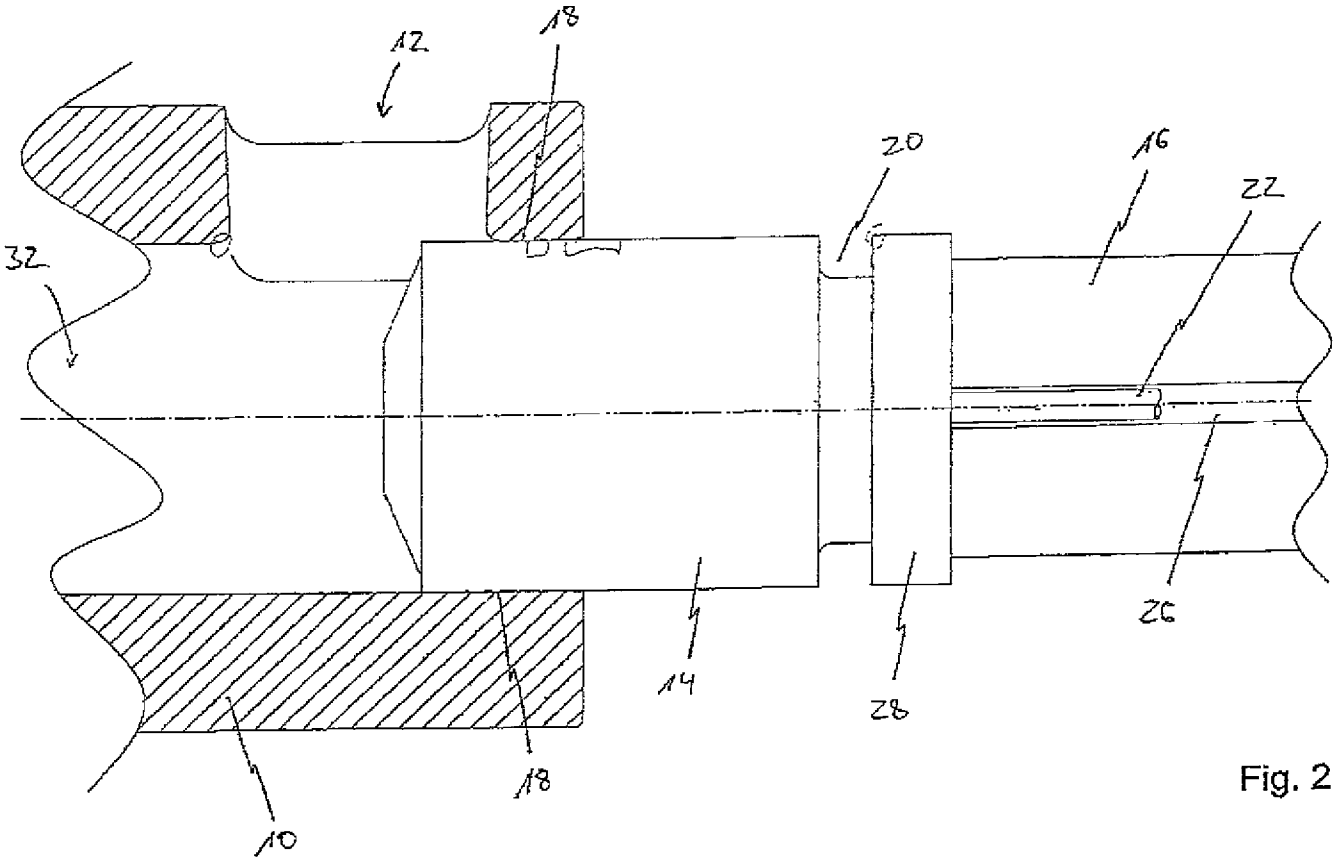

The vacuum die-casting system according to the invention has a casting mold, not shown here, that is composed of two mold halves, for example. The interior of the casting mold, in other words the cavity or the mold cavity, is connected with the casting chamber 10 that is filled with melt for the casting process. This melt is filled in through the filling opening 12 and pressed into the mold cavity by means of the casting piston 14. The gas present in the mold cavity is drawn off by way of a ventilation valve, for example a so-called wash board, not shown here. During the casting process, the solidifying metal rises all the way to this ventilation valve. The casting piston 14 is moved by a casting drive not shown here, by way of a casting piston rod 16, in other words moved in the casting chamber 10. Control takes place by way of the casting system control.

The vacuum die-casting system furthermore has a vacuum system, not shown here, which is connected with the casting chamber 10 and/or the mold cavity by way of corresponding vacuum lines, and evacuates the mold cavity, together with the entire space 32 of casting chamber 10 situated in front of the casting piston, for example at a predetermined point in time during the casting process, according to a predetermined path distance of the casting piston 14 or according to other criteria.

Because, in this connection, a ring gap 18 is present between the inner wall of the casting chamber 10 and the outer mantle of the casting piston 14, through which gap air or gases is/are drawn by the back side of the casting piston 14 out of the casting chamber 10 or into the melt that is being filled into it, whereby the penetrating gases actually foam up the melt in the casting chamber that is under vacuum, and produce a gas porosity in the cast part produced, which minimizes or excludes heat treatment and weldability, among other things, it is now provided, according to the invention, that the casting piston 14 has at least one depression 20 that is connected with the ring gap 18 in terms of flow technology and can be evacuated, and that means are provided by way of which the depression or hollow is evacuated.

In this result, a pressure difference that is essentially known from the state of the art and occurs during evacuation of the casting chamber and/or of the mold cavity of the casting mold, which difference leads to gases or air flowing into the casting chamber, is minimized to preferably eliminated, particularly preferably actually reversed, in such a manner that the flow direction changes and gases or air flow(s) out of the space 32 of the casting chamber 10 that is situated in front of the casting piston 14, into the depression 20, through the ring gap 18.

In this connection, the depression 20 that can be evacuated is configured—as shown in FIGS. 1 to 4—as a ring groove that runs around the casting piston 14, and is therefore situated, advantageously completely, in the flow path of the gases or air actually flowing through the ring gap 18 into the space 32 of the casting chamber 10, according to the state of the art.

The means for evacuation of the depression 20 comprise two suction pipes 22 that are each connected, with their one end 24, with the ring groove 20 that can be evacuated, in terms of flow technology, and, with their other end, with the aforementioned or another vacuum system, in terms of flow technology. In this connection, the suction pipes 22 are disposed to lie opposite one another, along the piston rod 16, in a groove 26 introduced into the outside of the piston rod 16, in each instance, whereby the end 24 makes a transition into the ring groove 20, by means of the piston region 28 that faces the piston rod 16, and is connected with it, in terms of flow technology. The piston rod 16 itself is configured to be hollow and has a piston cooling 30.

The casting piston 14 can be configured in one piece, whereby the piston region 28 is then part of the one-piece casting piston 14, and the depression 20 is introduced into the casting piston 14 in the form of a ring groove, for example by means of chi-removing milling.

Another one of the numerous possibilities for production of the depression 20 consists in that the piston region 28 is a separate work piece, for example in the form of a connecting ring that is disposed at a distance from the casting piston 14, particularly wedged in place on the piston rod 16. As a result, as can be seen in FIG. 1, for example, a depression 20 in the form of a ring groove is formed.

Figure 3:
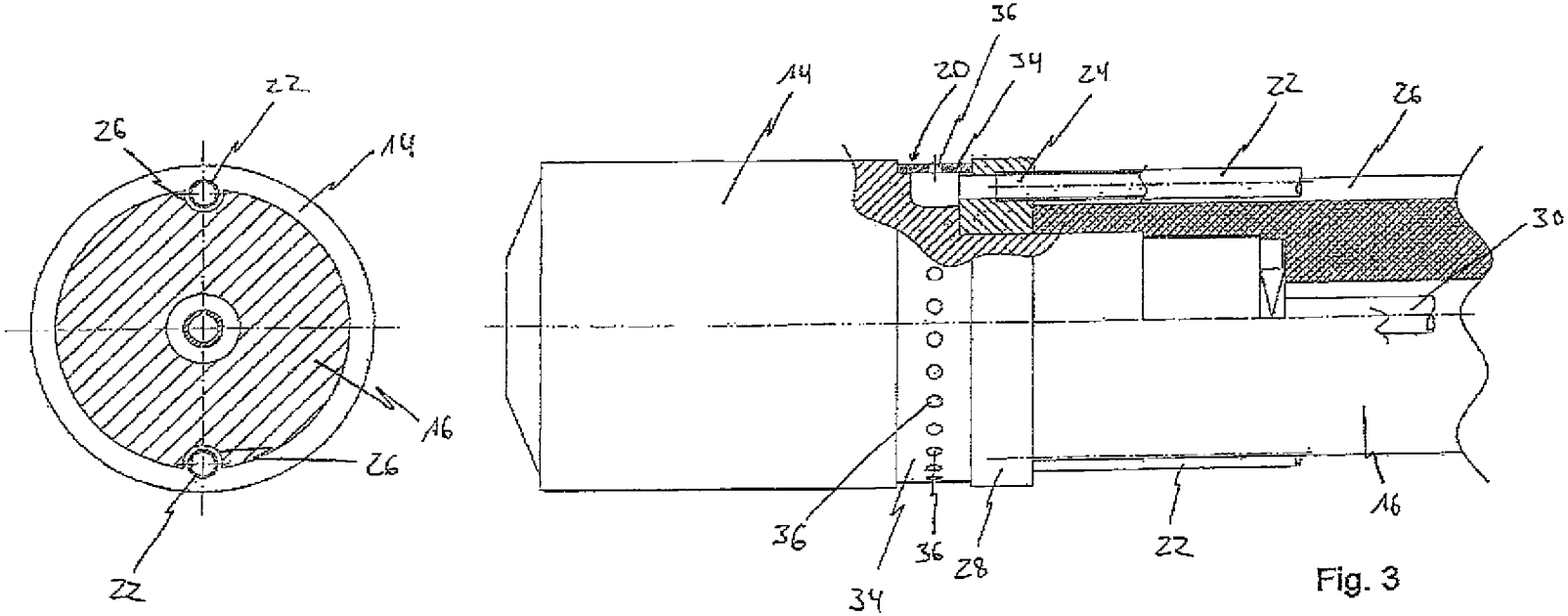

In FIG. 3, another one of the numerous possibilities for production of the depression 20 is shown. There, a first work piece in the form of a ring 34 is disposed behind the casting piston 14, whereby the ring 34 has a lesser outside diameter than the casting piston 14. The ring 34 has numerous depressions disposed distributed over the circumference, in the form of bores 36, which are connected on the inside of the ring, in terms of flow technology. It is advantageous here that evacuation on the inside of the ring leads to uniform evacuation of the circumferential depression 20. In this connection, these numerous depressions in the form of bores 26 form a kind of nozzle field. The ring 34 is followed by another work piece in the form of a connecting ring. This connecting ring then forms the aforementioned piston region 28 and corresponds to the casting piston 14 in terms of its outside diameter.

Figure 4:
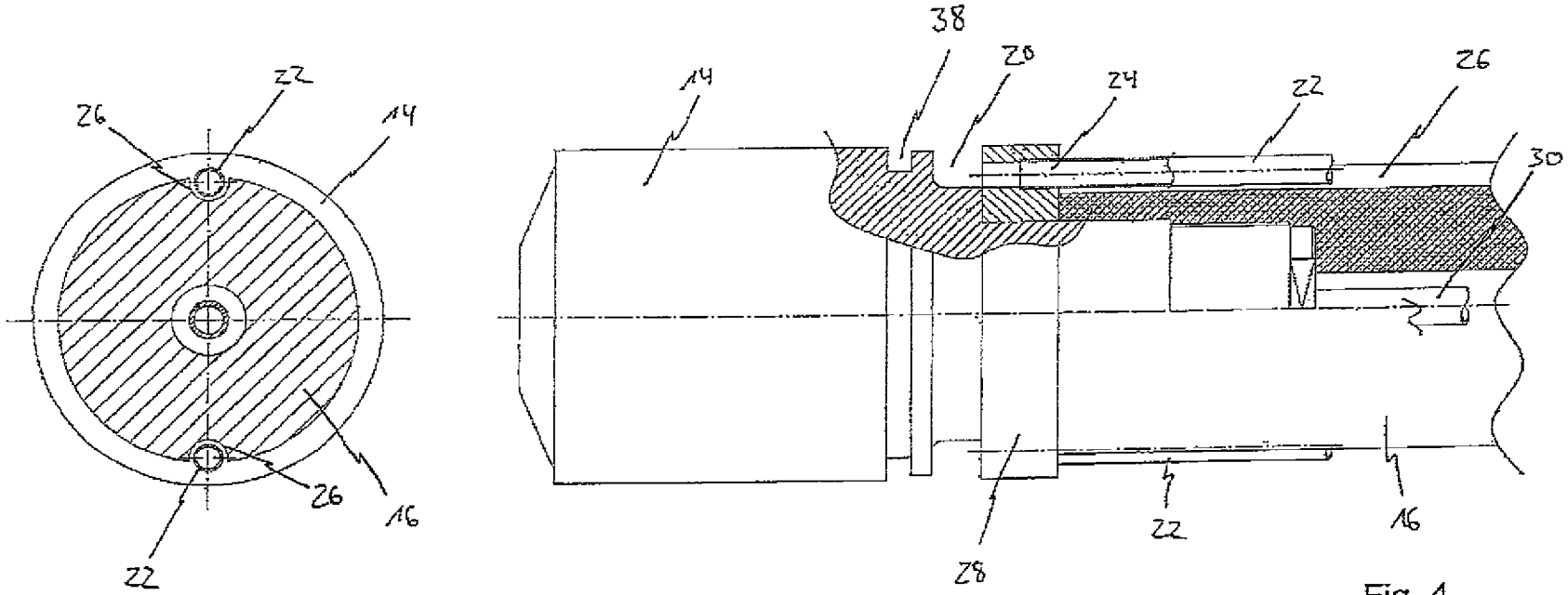

FIG. 4 finally shows the device according to FIG. 1, but has an additional collection depression 38 in the form of a ring groove that serves to capture undesirable substances such as metal flakes or lubricants and precedes the depression that can be evacuated.

The control for the vacuum die-casting system is advantageously connected with a control of the vacuum system for evacuation of the ring groove 20, whereby a simple path-controlled or time-controlled start signal for evacuation of the ring groove 20, transmitted to the vacuum system, is sufficient.

In the case of the method according to the invention for operation of a vacuum die-casting system, particularly according to one of claims 1 to 10, it is advantageous that after introduction of the casting melt into the casting chamber 10 through the filling opening 12, the casting piston 14 is first moved so far that the ring groove 20 has gone past the filling opening 12. Subsequently, preferably essentially at the same time with the evacuation of the mold cavity and of the casting chamber 10, the ring groove 20 is evacuated, in such a manner that no gases or air flow(s) into the casting chamber 10 through the aforementioned gap 18.

REFERENCE SYMBOL LIST (is not part of the specification)
10 casting chamber
12 filling opening
14 casting piston
16 piston rod
18 gap
20 ring groove
22 suction pipe
24 end
26 groove
28 piston region
30 piston cooling
32 space of the casting chamber in front of the casting piston
34 ring
36 depression/bore
38 collection depression

What is claimed is:

1. A vacuum die-casting system comprising
a casting chamber having a filling opening and an inner wall,
a casting piston able to be moved in the casting chamber and having an outer mantle,
a piston rod connecting the casting piston with a casting drive, and
an evacuator comprising a vacuum system and comprising at least one suction pipe having a first end and a second end,
wherein a ring gap is configured between the outer mantle of the casting piston and the inner wall of the casting chamber, and wherein the casting piston has at least one depression or hollow standing in a flow connection with the ring gap and able to be evacuated,
wherein the evacuator is able to evacuate the at least one depression or hollow,
wherein the first end of the at least one suction pipe is connected with the at least one depression or hollow, in terms of flow technology,
wherein the second end of the at least one suction pipe is connected with the vacuum system, in terms of flow technology,
wherein the at least one suction pipe runs along the piston rod on the outside of the piston rod,
wherein the first end of the at least one suction pipe makes a transition into the at least one depression or hollow via a piston region or a work piece region facing the piston rod, and
wherein the at least one suction pipe is connected with the piston region or the work piece region, in terms of flow technology.

2. The method for operation of a vacuum die-casting system according to claim 1, the method comprising steps of:
a) introducing a casting melt into the casting chamber, through the filling opening,
b) moving the casting piston until the at least one depression or hollow has gone past the filling opening, or tightly closing the filling opening and, if necessary, moving the casting piston until the at least one depression or hollow is positioned in the casting chamber, and
c) evacuating the at least one depression or hollow via at least one suction pipe running on the outside of the piston rod in a manner so that less to no gases or air flow(s) into the casting chamber through the ring gap.

3. The method according to claim 2, wherein the evacuation of the at least one depression or hollow is started by way of at least one of a path control and a time control.

* * * * *